United States Patent [19]

Lautenschläger

[11] 4,091,499

[45] May 30, 1978

[54] MOUNTING PLATE FOR FURNITURE HINGES

[75] Inventor: Karl Lautenschläger, Reinheim, Odenwald, Germany

[73] Assignee: Karl Lautenschläger KG Möbelbeschlagfabrik, Reinheim, Odenwald, Germany

[21] Appl. No.: 787,473

[22] Filed: Apr. 14, 1977

[30] Foreign Application Priority Data

Jun. 1, 1976 Germany .....2624453

[51] Int. Cl.[2] ..... E05D 7/04

[52] U.S. Cl. ..... 16/129

[58] Field of Search ..... 16/129–134, 16/163, 166, 164

[56] References Cited

U.S. PATENT DOCUMENTS

| | | | |
|---|---|---|---|
| 3,224,035 | 12/1965 | Heinze | 16/131 X |
| 3,772,735 | 11/1973 | Lautenschläger | 16/129 |
| 3,938,219 | 2/1976 | Rock et al. | 16/130 |

FOREIGN PATENT DOCUMENTS

| | | | |
|---|---|---|---|
| 2,307,107 | 4/1976 | France | 16/129 |
| 2,307,108 | 4/1976 | France | 16/129 |
| 2,460,127 | 6/1976 | Germany | 16/129 |

*Primary Examiner*—James Kee Chi

[57] ABSTRACT

Mounting plate for the installation of the supporting wall part of a cabinet hinge on a piece of furniture. The mounting plate is composed of a bottom piece to be applied directly to the supporting wall and a top piece displaceable on this bottom piece parallel to the hinge pivot axis and mounted thereon for selective fixation. The bottom piece and top piece can be fixed together on the supporting wall by means of two fastening screws spaced apart from one another in line with the adjustment direction and passing through apertures in the top and bottom piece, which screws can be driven into bores in the supporting wall. The openings in the top piece are in the form of elongated openings extending in the adjustment direction so that the top piece is displaceable in the elongated holes relative to the bottom piece when the fastening screws are loosened. Between the top piece and the bottom piece, an adjusting mechanism is provided which engages the bottom piece on the one hand and the top piece on the other and is accessible through an opening in the upper piece for engagement by a tool, and whose adjustment brings about a relative displacement of the top piece and bottom piece.

12 Claims, 10 Drawing Figures

MOUNTING PLATE FOR FURNITURE HINGES

BACKGROUND

The invention relates to a mounting plate for the attachment of the supporting wall part of a furniture hinge to a piece of furniture, which is composed of a bottom part to be attached directly to the supporting wall and a top part which is mounted on said bottom part so as to be displaceable thereon parallel to the hinge pivot axis and so as to be able to be locked in place as desired.

A two-piece mounting plate that is adjustable in height is known (German "Offenlegungsschrift" No. 20, 43, 622), which serves for the adjustable fastening of hinge members, which are usually of the cantilevered type, to supporting walls, the bottom piece being affixable by fastening screws to the supporting wall of the cabinet and the upper piece being affixable on the bottom piece by at least one separate fastening screw. This has the undeniable advantage that the upper piece can be adjusted without loosening the bottom piece from the supporting wall, but it necessitates a relatively complex and sturdy construction of the mounting plate parts. In particular, the bottom piece must, for reasons of stability, be made of metal so that the thread of the tapped hole receiving the fastening screw of the upper piece will be able to be tightened sufficiently, despite the small available depth of the tapped hole, without the danger of stripping the threads. Furthermore, the adjustment of the upper piece of the mounting plate relative to the bottom piece is difficult, even if the fastening screw has been loosened, if the top piece has become stuck in its guides to the bottom piece.

THE INVENTION

The invention is addressed to the problem of creating a two-piece mounting plate that will be adjustable for height and simple in construction, in which the bottom piece will be so greatly relieved of stress by the fastening screws that it can be manufactured inexpensively of plastic without danger even from shock loads, the relative adjustment of the upper piece and top piece being nevertheless accomplished simply and quickly, without great effort, by means of a screwdriver or other such tool.

Setting out from a mounting plate of the kind described in the beginning, this problem is solved in accordance with the invention in that the bottom and top piecesare affixable in common by means of two fastening screws which can be driven into holes in the supporting wall through openings in the bottom piece and top piece and which are set apart from one another in line with the direction of adjustment, that the openings in the upper part are in the form of elongated apertures extending in the direction of the adjustment, so that the top piece can be displaced relative to the bottom piece when the screws are loosened, and that, between the top piece and the bottom piece, an adjusting means is provided which engages the bottom piece on the one hand and the top piece on the other, which is accessible through an aperture in the top piece for engagement by a tool, and the adjustment of which produces a relative displacement of the top and bottom pieces.

The two pieces which together form the mounting plate are thus fastened to the supporting wall of the cabinet by screws driven into the supporting wall through both pieces the displacement of the bottom piece relative to the top piece being accomplished by means of the elongated holes provided in the upper piece when the screws are only slightly loosened. The displacement of the pieces relative to one another is facilitated by an adjusting means which can be engaged by the screwdriver which is needed for the lossening of the screws and for tightening them for adjustment.

The securing of the adjusted elevation, in addition to the fixing of the top piece by the gripping force of the fastening screws can be achieved in further development of the invention in that the confronting ends of the elongated holes provided in the top piece have each a straight edge terminating in a sharpened arris projecting towards the bottom piece, and that the upper side of the bottom piece facing the sharpened arrises (hereinafter to be referred to as the claws) are provided in the area of the claws with parallel grooves within the range of adjustment of the top and bottom pieces these grooves being engaged by the claws when the fastening screws are tightened.

In a preferred embodiment of the invention, the adjusting means is attached, at its inner end on the supporting wall side, to the bottom piece for pivoting about an axis that is parallel to the supporting wall of the cabinet and at right angles to the pivoting axis of the hinge to be mounted, and is supported at its upper terminal area away from the supporting wall on the walls of the opening in the top piece.

To assure that the adjusting means will be able to be rocked in the opening in the top part only in the anticipated manner, without being rotatable, the opening in the top piece has an other than circular, preferably rectangular or square shape, and the adjusting means has, at least in its area engaging the opening, a matching cross-sectional shape. Thus, the bottom piece is non-rotatably aligned by the adjusting means in its position relative to the top piece.

The bottom piece and the adjusting means can advantageously be injection molded in one piece from plastic and can be joined together by a flexible portion permitting the required rocking. This embodiment permits very simple and inexpensive manufacture and prevents the accidental loss of the adjusting piece before or during assembly with the top piece.

Alternatively, the adjusting means can be rotatably mounted in the opening of circular cross section in the top piece and can have at its inner end on the supporting wall side a cam portion engaging the walls of an elongated hole in the bottom piece running at right angles to the direction of adjustment. This embodiment, in which the adjustment is performed by turning the adjusting means mounted in the upper piece, and in which the cam portion engages the elongated hole in the bottom piece, permits an especially delicate and precise adjustment, although it does require that the bottom piece and the adjusting means be manufactured separately. Since, however, in this case, too, both the bottom piece and the adjusting means can be injection molded integrally from plastic together with the eccentric portion, the manufacture of the mounting plate of this design is still much less expensive than the known two-piece mounting plates made entirely of metal.

For the insertion of the tip of a screwdriver or other such tool, a slot can be provided in the surface of the adjusting means which is visible in the opening in the upper piece. In the case of the adjusting means which pivotingly engages the bottom piece, the slot will be at right angles to the adjustment direction, and the adjustment will be made by pivoting the screwdriver inserted into the slot in the direction of the adjustment.

To make possible the loss-proof preassembly of the bottom piece to the top piece the adjusting means in a preferred further development of the invention is provided with a stud projecting slightly above the opening in the top piece when the top and bottom pieces are properly assembled, and having a slot of such depth that it extends into the opening in the top piece, and having also at least one lateral snap-attachment projection such that, when the stud is passed through the opening in the top piece the stud will be compressed and will catch on the upper side of the top piece preventing its withdrawal from the opening.

The invention will now be further explained with the aid of two embodiments in conjunction with the appended drawings wherein.

Figure 1:
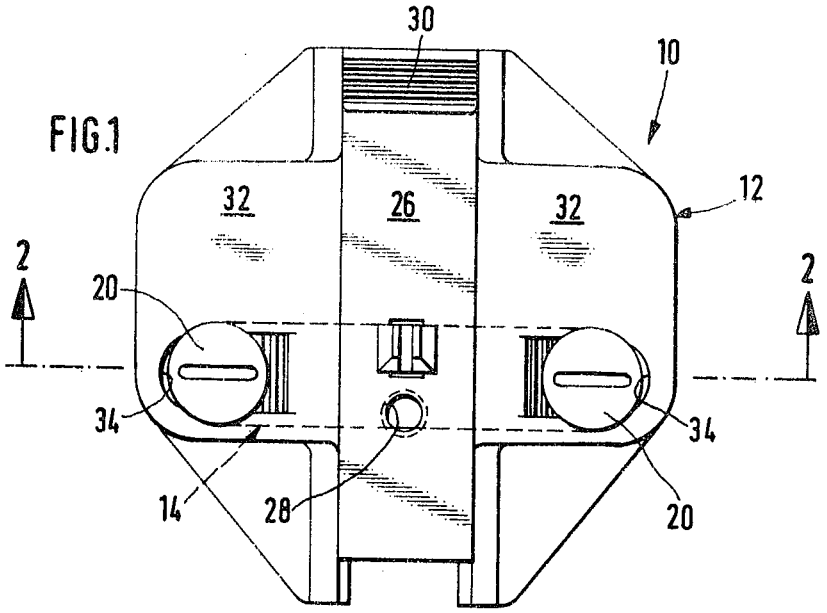
FIG. 1 is a top plan view of a first embodiment of a mounting plate in accordance with the invention, composed of a bottom piece and of a top piece which is adjustable relative thereto.
Figure 2:
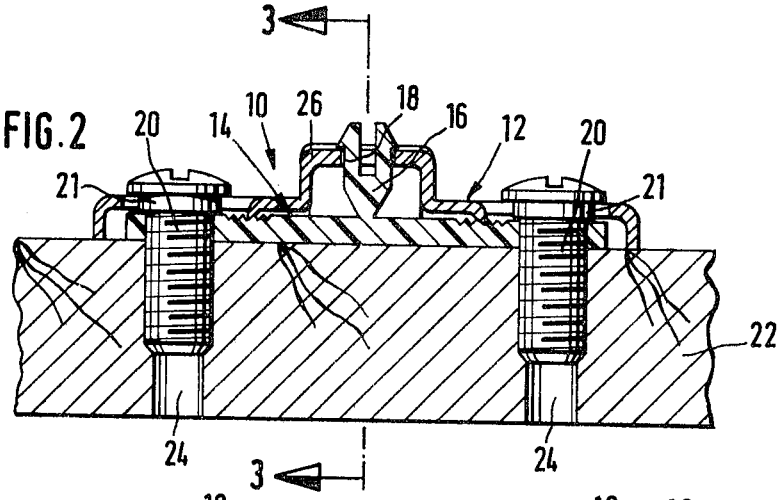
FIG. 2 is a cross-sectional view taken in the direction of the arrows 2—2 of FIG. 1.
Figure 3:
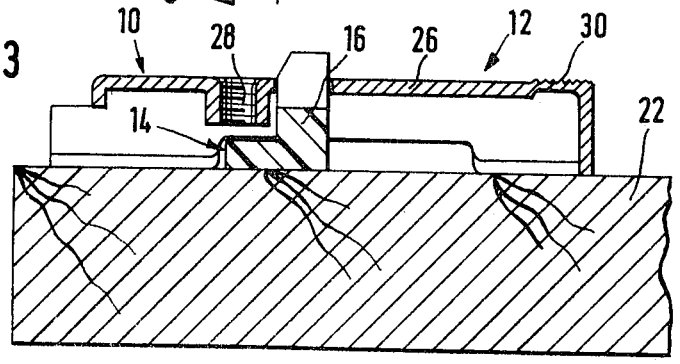
FIG. 3 is a cross-sectional view taken in the direction of the arrows 3—3 in FIG. 2.
Figure 4:
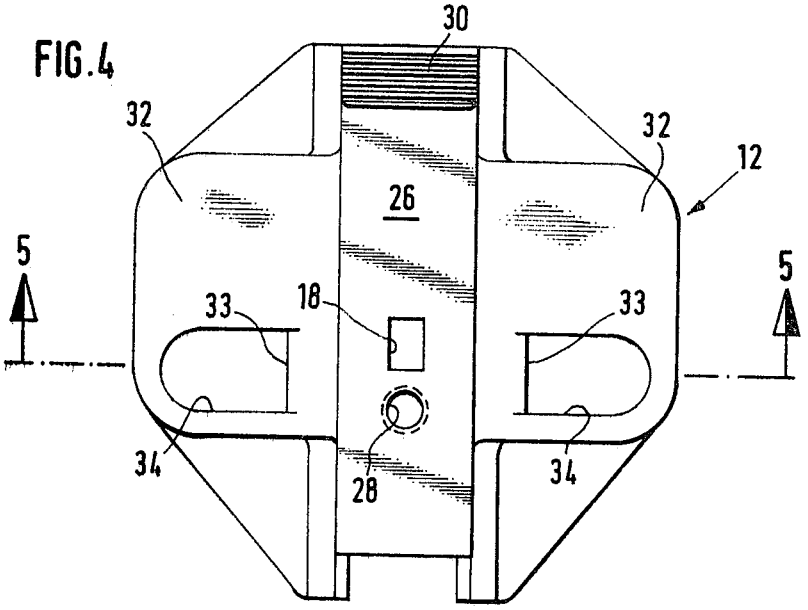
FIG. 4 is a top plan view of the top piece of the mounting plate shown in FIG. 1-3.
Figure 5:
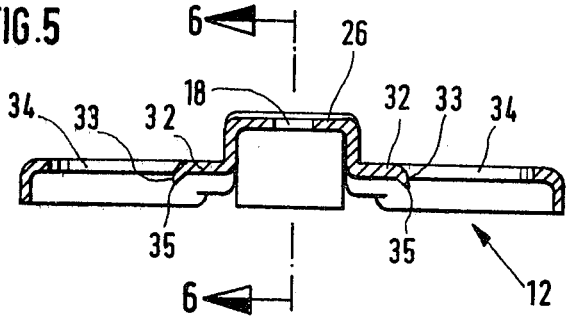
FIG. 5 is a cross-sectional view taken in the direction of the arrows 5—5 of FIG. 4.
Figure 6:
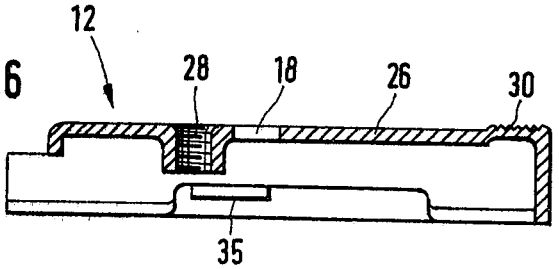
FIG. 6 is a cross-sectional view taken in the direction of the arrows 6—6 of FIG. 5.
Figure 7:
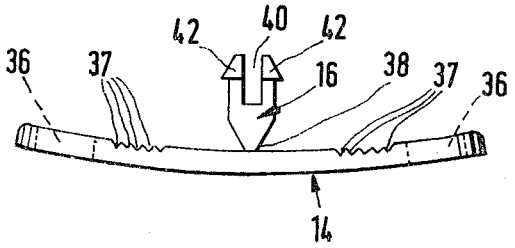
FIG. 7 is a side elevational view of the bottom piece of the mounting plate shown in FIGS. 1-3.
Figure 8:
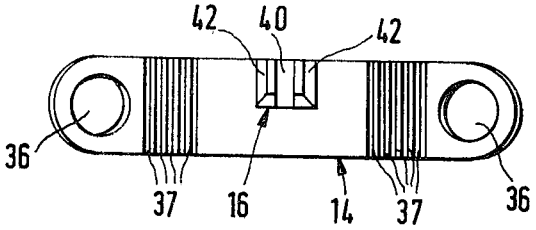
FIG. 8 is a top plan view of the bottom piece shown in FIG. 7.

The mounting plate shown in FIGS. 1 to 3, which is generally identified by the numeral 10, is composed of a recessed top piece 12 pressed from sheet metal (FIGS. 4 to 6) and a bottom piece injection molded from plastic (FIGS. 7 and 8, which are joined together by an adjusting means 16 made integrally with the bottom piece 14 and having an upwardly projecting stud portion 16 which is the adjusting means and whose upper end is snap-fastened into an opening 18 in the upper piece 12 and is accessible from without. The top and bottom pieces are together affixed to the supporting wall 22 of a cabinet by two fastening screws 20 in line with the desired direction of the adjustment of the top piece, the position and spacing of the openings provided in the top and bottom pieces for the screws 20 being able to be selected such that the screws can be driven into adjacent free holes 24 of the front row of holes in the supporting wall of a cabinet which are provided for the accommodation of shelf holders. In this manner it becomes unnecessary— although it is of course also possible—to provide special holes for fastening the mounting plate.

The top piece 12 of the mounting plate 10 has an elongated middle section 26 created by embossing, which serves for the adjustable mounting of a cantilever arm of a hinge. For this purpose a tapped hole 28 is provided adjacent the opening 18 for receiving the upper end of the adjusting means, a tapped hole 28 serving for the accommodation of the threads of the screw for attaching the cantilever arm. Furthermore, at the rearward end (at the top in FIGS. 1 and 4) of the section 26 there is provided a transverse set of grooves 30 which cooperates with downwardly extending lateral teeth on the cantilever arm to be installed, and permits it to be adjustably fixed in the lengthwise direction. Shallowly embossed flange sections extend laterally from section 26, into which an elongated opening 34 is stamped for the screws 20. When the screws are loose, the top piece 12 is thus displaceable along the length of the elongated openings, within the limits thereof, relatively to the screws 20. The guidance of the top piece assured by a shoulder 21 provided beneath the head of the screws 20, which engages the longitudinal edges of elongated opening.

The inner end, i.e., the one facing the section 26, of each elongated opening 34 has a straight edge 33 terminating in an inwardly projecting, sharpened arris 35 which contributes, in a manner to be explained further on, for the secure location of the top piece 12 on the bottom piece 14 when the fastening screws 20 are tightened.

The bottom piece 14, represented in FIGS. 7 and 8, is inserted into the interior of the embossed top piece 12. The flat, elongated bottom piece has two openings 36 of circular cross section of the same spacing as the mounting holes provided in the supporting wall 22 of the cabinet, the diameter of said openings being slightly smaller than the outside diameter of the threaded portion of the screws 20. When the screws 20 are driven, their threads cut a thread in the plastic material of the bottom piece 14, which will hold the mounting plate 10 assembled unless they are not removed entirely from the apertures 36.

In FIG. 7 it can be seen that the bottom piece is slightly curved. When it is installed in the top piece 12, the bottom piece is flattened out of this curved state and will then be under a certain tension inside of the top piece.

In the center of the bottom piece 14, the adjusting means 16 is formed in one piece with same, and is in the form of an upwardly projecting stud of rectangular cross section. To enable the adjusting means 16 to be turned relative to the bottom piece 14, the portion of the adjusting means 16 where it is joined to the bottom piece 14 is constructed as a flexible neck 38 having a smaller cross-sectional area than the cross-sectional area of the adjusting means 16. A slot 40 extending dowardly from the top face of the adjusting means divides the adjusting means 16 at its upper end into two sections which can be deflected resiliently against one another, at whose extremities snap fastening projections 42 projecting laterally outwardly are formed, which, when the bottom part 14 is properly installed in the top piece catch on the top side of section 26. Since the snap fastening projections 42 are beveled towards the top, the bottom piece 14 is assembled with the top piece 12 simply by pushing the top end of the adjusting means 16 from the inside through the opening 18 in section 26 of the top piece. The opening 18 accommodates the rectangular shank portion of the adjusting means matingly, i.e., it also has a rectangular cross section.

The slot 40 furthermore serves as an adjusting slot for engagement by the tip of a screwdriver when the screws 20 have been loosened for the purpose of shifting the top piece 12 relative to the bottom piece and hence also to the supporting wall 22, in the direction of the elongated openings 34. For this purpose the screwdriver is inserted into the slot 40 and is then pivoted in the desired adjustment direction. Since the bottom piece 14 is fixed in its position on the supporting wall 22 by the screws 20 and hence the neck 38 of the adjusting piece cannot change its position, either, the screwdriver, by rocking the adjusting means 16, produces the desired shifting of the top piece 12. It is clear that the adjusting means 16 could also be constructed as a separate piece pivotingly joined in some appriate manner with the bottom piece 14, but the one-piece construction described above is preferred.

For the adjustment of the top piece 12 relative to the bottom piece the straight edge 33 can also be used, by engaging this edge with the flat side of the blade of a screwdriver with the other flat side braced against the head of the screw 20. By rocking the screwdriver in the direction opposite the desired adjustment direction, the top piece 12 can be shifted in the desired direction relative to the bottom piece 14.

Between the adjusting means 16 and each aperture 36 there is provided a series of parallel grooves 37 running at right angles to the direction of adjustment. Depending on the height adjustment of the top piece relative to the bottom piece, the sharpened arris 35 of each edge 33 engages one of the grooves 37 when the screws 20 are fastened and thus produces a positive locking of the top piece on the bottom piece.

Figure 9:
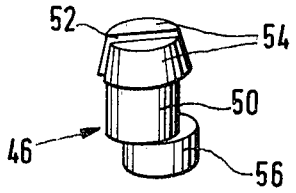
FIG. 9 is a perspective view of the adjusting means of a modified embodiment of a mounting plate of the invention.
Figure 10:
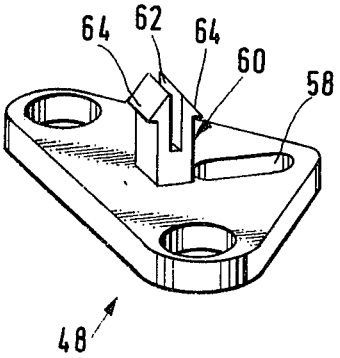
FIG. 10 is also a perspective view of the bottom piece of the modified embodiment, cooperating with the adjusting means represented in FIG. 9.

In FIGS. 9 and 10 the adjusting means 46 and the bottom piece 48, respectively, of a modified embodiment of the mounting plate of the invention are represented. The top piece of this modified mounting plate is largely the same as the previously described top piece, except that the opening 18 must be circular to accommodate the adjusting means in this case, since the adjusting means is mounted for rotation in the associated aperture of the top piece, which is not shown. Accordingly, the shank 50 of the adjusting means is also of circular cross section. At the upper end, the adjusting means 46 is again provided with a slot corresponding to the slot 40 in the previously described embodiment, with laterally projecting snap-fastening projections 54 beveled towards the insertion point. At its bottom end the shank 50 has a laterally offset excentric section 56.

This excentric section 56 engages an elongated opening 58 in the bottom piece 48 and therefore permits a relative displacement of the top and bottom pieces through the rotation of the adjusting piece 46 by means of a screwdriver introduced into the slot 52. The upwardly projecting stud member 60 shown at the front end of the elongated opening 58 serves for the additional snap fastening of the bottom piece 14 to the top piece 12, which must therefore additionally have a rectangular aperture, in addition to the above-described circular aperture, so as to accommodate the adjusting means 46 for this stud member 60. This aperture can, of course, be dispensed with if the stud member 60 is omitted, which is also basically possible since the holding together of the top and bottom pieces can also be provided for by means of the fastening screws. To make the required height adjustment possible, the aperture for the stud member 60 must, of course, have sufficient length in the adjustment direction, so that the projection can shift within the opening within its range of adjustment. The snap fastening of the stud member 60 is performed similarly to the snap fastening of the above-described adjusting means 40 or 46 by providing a slot 62 in the end of the stud 60, laterally projecting snap fastening claws 64, which are beveled in the insertion direction, being provided on the resilient legs thus formed, which engage the edges of the associated opening in top piece extending in the adjustment direction.

I claim:

1. A mounting plate for the installation of the supporting wall part of a cabinet hinge on a piece of furniture, said mounting plate being composed of a bottom piece to be applied directly to the supporting wall and a top piece displaceable on this bottom piece parallel to the hinge pivot axis and mounted thereon for selective fixation, fastener means for connecting said bottom piece and said top piece on the supporting wall, said fastener means being spaced apart from one another in line with the adjustment direction and passing through openings in the top and bottom piece, said fastener means being adapted to be driven into bores in said supporting wall, said openings in said top piece being in the form of elongated openings extending in the adjustment direction so that said top piece is displaceable in the elongated holes relative to the bottom piece when the fastening means are loosened while said bottom piece is held in place relative to the supporting wall, adjusting means between said top piece and said bottom piece, which engages said bottom piece and said top piece and is accessible through an opening in the top piece for engagement by a tool, adjustment of said adjusting means effecting a positive relative displacement of said top piece and said bottom piece.

2. A mounting plate according to claim 1, wherein the ends of the elongated holes confronting each other and provided in said upper piece each have a straight boundary edge terminating in a sharpened locking edge projecting towards said bottom piece, the top side of said bottom piece facing the locking edges being provided within the adjustment range of the top and bottom piece in the area of the locking edges, with parallel tooth grooves into which the locking edges are adapted to be brought in form-locking engagement when the fastener means are tightened.

3. A mounting plate according to claim 1, wherein said adjusting means is attached at its inner end on the supporting wall side to the bottom piece so as to be able to pivot about an axis extending parallel to the supporting wall of the piece of furniture and at a right angle to the pivot axis of the hinge to be mounted, and is supported at its upper end area facing away from the supporting wall on the walls of the opening in the top piece.

4. A mounting plate according to claim 3, wherein the opening in the top piece has a shape differing from a circular shape, and wherein said adjusting means has, at least in its area engaging the opening a complementary cross-sectional shape.

5. A mounting plate according to claim 4, wherein said shape is rectangular.

6. A mounting plate according to claim 4, wherein said shape is square.

7. A mounting plate according to claim 3 wherein said bottom piece and said adjusting means are injection molded integrally from plastic, and a flexible step holding together said bottom piece and adjusting means while allowing for necessary flexure.

8. A mounting plate according to claim 1, wherein said adjusting means is rotatably mounted in an opening of circular cross section in the top piece and has on its inner end facing the supporting wall an eccentric cross section which engages the side walls of an elongated opening in the bottom piece, which extends at right angles to the adjustment direction.

9. A mounting plate according to claim 8, wherein said bottom piece has a projection projecting from its top side, which projection can be snap-fastened in an opening in the upper piece, said last-mentioned opening being of such dimension in the adjustment direction that the projection can move in the adjustment direction therein.

10. A mounting plate according to claim 3, wherein said adjusting means has a face visible in said opening in said top piece, and a slot provided in said face for insertion of the front end of a tool.

11. A mounting plate according to claim 10, wherein said slot in said adjusting means is disposed at right angles to the adjustment direction.

12. A mounting plate according to claim 10, wherein said adjusting means is of such dimension in height that, when said top and bottom pieces are assembled, it projects slightly from said opening in said top piece and wherein said slot in said adjusting means is so deep that it reaches into said opening in said top piece, and wherein said adjusting means has in the area projecting from the opening in the top piece at least one lateral snap-attachment projection adapted to be pushed through the opening with compression of the projecting portion, and snap-fastens said adjusting means on the top side of the top piece against withdrawal from the opening.

* * * * *